US008582788B2

(12) United States Patent
Leidl et al.

(10) Patent No.: US 8,582,788 B2
(45) Date of Patent: Nov. 12, 2013

(54) MEMS MICROPHONE

(75) Inventors: Anton Leidl, Hohenbrunn (DE); Wolfgang Pahl, Munich (DE); Ulrich Wolff, Kaiserslautern (DE)

(73) Assignee: EPCOS AG, Munich (DE)

( * ) Notice: Subject to any disclaimer, the term of this patent is extended or adjusted under 35 U.S.C. 154(b) by 1147 days.

(21) Appl. No.: 11/816,969

(22) PCT Filed: Feb. 8, 2006

(86) PCT No.: PCT/EP2006/001121
§ 371 (c)(1),
(2), (4) Date: May 22, 2008

(87) PCT Pub. No.: WO2006/089641
PCT Pub. Date: Aug. 31, 2006

(65) Prior Publication Data

US 2008/0267431 A1 Oct. 30, 2008

(30) Foreign Application Priority Data

Feb. 24, 2005 (DE) ..... 10 2005 008 511

(51) Int. Cl.
*H04R 25/00* (2006.01)

(52) U.S. Cl.
USPC ..... 381/173; 381/174; 381/190; 381/355; 381/361; 381/369

(58) Field of Classification Search
USPC ..... 381/173, 174, 190, 355, 361, 369
See application file for complete search history.

(56) References Cited

U.S. PATENT DOCUMENTS

| | | | |
|---|---|---|---|
| 2,105,010 | A | 1/1938 | Sawyer |
| 3,447,217 | A | 6/1969 | Kumada |
| 3,587,322 | A | 6/1971 | Lobdell et al. |
| 3,726,002 | A | 4/1973 | Greenstein et al. |
| 3,735,211 | A | 5/1973 | Kapnias |
| 3,980,917 | A | 9/1976 | Kakizaki et al. |
| 4,127,840 | A | 11/1978 | House |
| 4,222,277 | A | 9/1980 | Kurtz |
| 4,277,814 | A | 7/1981 | Giachino et al. |
| 4,314,226 | A | 2/1982 | Oguro et al. |
| 4,424,419 | A | 1/1984 | Chaput et al. |

(Continued)

FOREIGN PATENT DOCUMENTS

| | | |
|---|---|---|
| CA | 2315417 | 2/2001 |
| DE | 198 06 818 | 11/1999 |

(Continued)

OTHER PUBLICATIONS

"Design of a silicon microphone with differential read-out of a sealed double parallel-plate capacitor" by Jesper Bay et al., Sensors and Actuators A 53 (1996), pp. 232-236.*

(Continued)

*Primary Examiner* — Thao Le
*Assistant Examiner* — Matthew Gordon
(74) *Attorney, Agent, or Firm* — Fish & Richardson P.C.

(57) ABSTRACT

A microphone includes a first diaphragm and a second diaphragm coupled to the first diaphragm by a closed air volume. The first diaphragm and the second diaphragm each constitutes a piezoelectric diaphragm. The first diaphragm and the second diaphragm are electrically coupled so that movement of the first diaphragm causes movement of the second diaphragm.

23 Claims, 2 Drawing Sheets

(56) References Cited

U.S. PATENT DOCUMENTS 4,454,440 A 6/1984 Cullen
4,456,796 A 6/1984 Nakagawa et al.
4,504,703 A 3/1985 Schneiter et al.
4,533,795 A 8/1985 Baumhauer
4,545,440 A 10/1985 Treadway
4,558,184 A 12/1985 Busch-Vishniac et al.
4,628,740 A 12/1986 Ueda et al.
4,641,054 A 2/1987 Takahata et al.
4,691,363 A 9/1987 Khanna
4,737,742 A 4/1988 Takoshima et al.
4,776,019 A 10/1988 Miyatake
4,816,125 A 3/1989 Muller et al.
4,817,168 A 3/1989 Fidi
4,825,335 A 4/1989 Wilner
4,866,683 A 9/1989 Phillips
4,908,805 A 3/1990 Sprenkels et al.
4,910,840 A 3/1990 Sprenkels et al.
4,984,268 A 1/1991 Brown et al.
4,985,926 A 1/1991 Foster
5,059,848 A 10/1991 Mariani
5,091,051 A 2/1992 Greer
5,101,543 A 4/1992 Cote et al.
5,146,435 A 9/1992 Bernstein
5,151,763 A 9/1992 Marek et al.
5,153,379 A 10/1992 Guzuk et al.
5,178,015 A 1/1993 Loeppert et al.
5,184,107 A 2/1993 Maurer
5,216,490 A 6/1993 Greiff et al.
5,257,547 A 11/1993 Boyer
5,357,807 A 10/1994 Guckel et al.
5,394,011 A 2/1995 Yamamoto et al.
5,408,731 A 4/1995 Berggvist et al.
5,449,909 A 9/1995 Kaiser et al.
5,452,268 A 9/1995 Bernstein
5,459,368 A 10/1995 Onishi et al.
5,465,008 A 11/1995 Goetz et al.
5,477,008 A 12/1995 Pasqualoni et al.
5,490,220 A 2/1996 Loeppert
5,506,919 A 4/1996 Roberts
5,531,787 A 7/1996 Lesinski et al.
5,545,912 A 8/1996 Ristic et al.
5,573,435 A 11/1996 Grabbe et al.
5,592,391 A 1/1997 Muyshondt et al.
5,593,926 A 1/1997 Fujihira
5,650,685 A 7/1997 Kosinski et al.
5,659,195 A 8/1997 Kaiser et al.
5,712,523 A 1/1998 Nakashima et al.
5,739,585 A 4/1998 Akram et al.
5,740,261 A 4/1998 Loeppert et al.
5,748,758 A 5/1998 Menasco, Jr. et al.
5,821,665 A 10/1998 Onishi et al.
5,831,262 A 11/1998 Greywall et al.
5,838,551 A 11/1998 Chan
5,852,320 A 12/1998 Ichihashi
5,870,482 A 2/1999 Loeppert et al.
5,872,397 A 2/1999 Diffenderfer et al.
5,886,876 A 3/1999 Yamaguchi
5,889,872 A 3/1999 Sooriakumar et al.
5,901,046 A 5/1999 Ohta et al.
5,923,995 A 7/1999 Kao et al.
5,939,968 A 8/1999 Nguyen et al.
5,990,418 A 11/1999 Bivona et al.
5,999,821 A 12/1999 Kaschke
6,012,335 A 1/2000 Bashir et al.
6,052,464 A 4/2000 Harris
6,057,222 A 5/2000 Pahl et al.
6,075,867 A 6/2000 Bay et al.
6,078,245 A 6/2000 Fritz et al.
6,108,184 A 8/2000 Minervini et al.
6,118,881 A 9/2000 Quinlan et al.
6,136,175 A 10/2000 Stelzl et al.
6,136,419 A 10/2000 Fasano et al.
6,150,753 A 11/2000 DeCastro
6,157,546 A 12/2000 Petty et al.
6,163,071 A 12/2000 Yamamura
6,178,249 B1 1/2001 Hietanen et al.
6,182,342 B1 2/2001 Sawin
6,187,249 B1 2/2001 Lewellin
6,191,928 B1 2/2001 Rector et al.
6,236,145 B1 5/2001 Biernacki
6,242,842 B1 6/2001 Pahl et al.
6,282,072 B1 8/2001 Minervini et al.
6,310,420 B1 10/2001 Pahl et al.
6,324,907 B1 12/2001 Halteren et al.
6,398,943 B1 6/2002 Arens-Fischer et al.
6,400,065 B1 6/2002 Toda et al.
6,413,408 B1 7/2002 Berger et al.
6,433,412 B2 8/2002 Ando et al.
6,437,449 B1 8/2002 Foster
6,439,869 B1 8/2002 Seng et al.
6,449,828 B2 9/2002 Pahl et al.
6,492,194 B1 12/2002 Bureau et al.
6,519,822 B1 2/2003 Stelzl et al.
6,522,762 B1 2/2003 Mullenborn
6,528,924 B1 3/2003 Stelzl et al.
6,530,515 B1 3/2003 Glenn et al.
6,555,758 B1 4/2003 Stelzl et al.
6,566,672 B1 5/2003 Schlough et al.
6,594,369 B1 7/2003 Une
6,613,605 B2 9/2003 Pace
6,614,911 B1 9/2003 Bryson et al.
6,621,392 B1 9/2003 Volant et al.
6,625,031 B2 9/2003 Sano et al.
6,649,446 B1 11/2003 Goetz et al.
6,674,159 B1 1/2004 Peterson et al.
6,685,168 B1 2/2004 Stelzl et al.
6,710,840 B2 3/2004 Umemoto
6,722,030 B1 4/2004 Stelzl et al.
6,732,588 B1 5/2004 Mullenborn et al.
6,781,231 B2 8/2004 Minervini
6,800,987 B2 10/2004 Toda
6,809,413 B1 10/2004 Peterson et al.
6,829,131 B1 12/2004 Loeb et al.
6,838,739 B2 1/2005 Stelzl et al.
6,838,972 B1 1/2005 Minervini
6,871,388 B2 3/2005 Ishino et al.
6,904,155 B2 6/2005 Yonehara et al.
6,909,183 B2 6/2005 Feiertag et al.
6,924,429 B2 8/2005 Kasai et al.
6,924,974 B2 8/2005 Stark
6,930,364 B2 8/2005 Bruner
6,982,380 B2 1/2006 Hoffman et al.
7,003,127 B1 2/2006 Sjursen
7,053,456 B2 5/2006 Matsuo
7,072,482 B2 7/2006 Van Doorn et al.
7,080,442 B2 7/2006 Kawamura et al.
7,091,651 B2 8/2006 Kinoshita
7,092,539 B2 8/2006 Sheplak et al.
7,094,626 B2 8/2006 Stelzl et al.
7,145,283 B2 12/2006 Takeuchi et al.
7,146,016 B2 12/2006 Pedersen
7,166,910 B2 1/2007 Minervini
7,242,089 B2 7/2007 Minervini
7,259,041 B2 8/2007 Stelzl et al.
7,298,856 B2 11/2007 Tajima et al.
7,381,589 B2 6/2008 Minervini
7,388,281 B2 6/2008 Krueger et al.
7,434,305 B2 10/2008 Minervini
7,439,616 B2 10/2008 Minervini
7,492,019 B2 2/2009 Carley
7,518,201 B2 4/2009 Stelzl et al.
7,518,249 B2 4/2009 Krueger et al.
7,537,964 B2 5/2009 Minervini
7,544,540 B2 6/2009 Bauer et al.
7,608,789 B2 10/2009 Krueger et al.
7,692,288 B2 4/2010 Zhe et al.
7,903,831 B2 3/2011 Song
8,018,049 B2 9/2011 Minervini
8,169,041 B2 5/2012 Pahl et al.
8,184,845 B2 5/2012 Leidl et al.
8,229,139 B2 7/2012 Pahl
2001/0010444 A1 8/2001 Pahl et al.
2002/0067663 A1 6/2002 Loeppert et al.
2002/0074239 A1 6/2002 Berger et al.

(56) References Cited

U.S. PATENT DOCUMENTS

| | | | | |
|---|---|---|---|---|
| 2002/0076910 | A1 | 6/2002 | Pace | |
| 2002/0084722 | A1 | 7/2002 | Vaughn | |
| 2002/0102004 | A1 | 8/2002 | Minervini | |
| 2002/0110256 | A1 | 8/2002 | Watson et al. | |
| 2003/0007651 | A1 | 1/2003 | Nakashima et al. | |
| 2003/0010530 | A1 | 1/2003 | Scheel et al. | |
| 2003/0034536 | A1 | 2/2003 | Scheeper et al. | |
| 2003/0035558 | A1 | 2/2003 | Kawamura et al. | |
| 2003/0047806 | A1 | 3/2003 | Stelzl et al. | |
| 2003/0124829 | A1 | 7/2003 | Pace | |
| 2003/0133588 | A1 | 7/2003 | Pedersen | |
| 2003/0151133 | A1 | 8/2003 | Kinayman et al. | |
| 2003/0153116 | A1 | 8/2003 | Carley et al. | |
| 2004/0032705 | A1 | 2/2004 | Ma | |
| 2004/0046245 | A1 | 3/2004 | Minervini | |
| 2004/0058473 | A1 | 3/2004 | Feiertag et al. | |
| 2004/0064941 | A1 | 4/2004 | Dozier et al. | |
| 2004/0118595 | A1 | 6/2004 | Flammer et al. | |
| 2004/0150939 | A1 | 8/2004 | Huff | |
| 2004/0161530 | A1 | 8/2004 | Stark | |
| 2004/0231872 | A1 | 11/2004 | Arnold et al. | |
| 2004/0237299 | A1 | 12/2004 | Stelzl et al. | |
| 2004/0239449 | A1 | 12/2004 | Stelzl et al. | |
| 2005/0018864 | A1 | 1/2005 | Minervini | |
| 2005/0034888 | A1 | 2/2005 | Hoffman et al. | |
| 2005/0040734 | A1 | 2/2005 | Kinoshita | |
| 2005/0069164 | A1 | 3/2005 | Muthuswamy et al. | |
| 2005/0121785 | A1 | 6/2005 | Stelzl et al. | |
| 2005/0124181 | A1 | 6/2005 | Brown et al. | |
| 2005/0185812 | A1* | 8/2005 | Minervini | 381/355 |
| 2005/0218488 | A1 | 10/2005 | Matsuo | |
| 2005/0242420 | A1 | 11/2005 | Matsuda et al. | |
| 2005/0270135 | A1 | 12/2005 | Chua et al. | |
| 2006/0082260 | A1 | 4/2006 | Kinoshita | |
| 2006/0151203 | A1 | 7/2006 | Krueger et al. | |
| 2006/0157841 | A1 | 7/2006 | Minervini | |
| 2006/0249802 | A1 | 11/2006 | Stelzl et al. | |
| 2007/0069354 | A1 | 3/2007 | Dangelmaier et al. | |
| 2007/0082421 | A1 | 4/2007 | Minervini | |
| 2007/0099327 | A1 | 5/2007 | Hartzell et al. | |
| 2007/0127982 | A1 | 6/2007 | Bohlen et al. | |
| 2007/0189558 | A1 | 8/2007 | Ogura et al. | |
| 2007/0201715 | A1 | 8/2007 | Minervini | |
| 2007/0202627 | A1 | 8/2007 | Minervini | |
| 2007/0217635 | A1 | 9/2007 | Ogura et al. | |
| 2007/0222056 | A1 | 9/2007 | Bauer et al. | |
| 2008/0038577 | A1 | 2/2008 | Kruger et al. | |
| 2008/0048317 | A1 | 2/2008 | Krueger et al. | |
| 2008/0247585 | A1 | 10/2008 | Leidl et al. | |
| 2008/0279407 | A1 | 11/2008 | Pahl | |
| 2009/0001553 | A1 | 1/2009 | Pahl et al. | |
| 2009/0071710 | A1 | 3/2009 | Stelzl et al. | |
| 2009/0080682 | A1 | 3/2009 | Ogura et al. | |
| 2009/0104415 | A1 | 4/2009 | Schmajew et al. | |
| 2009/0127697 | A1 | 5/2009 | Pahl | |
| 2011/0186943 | A1 | 8/2011 | Pahl et al. | |
| 2011/0210409 | A1 | 9/2011 | Minervini | |

FOREIGN PATENT DOCUMENTS

| | | |
|---|---|---|
| DE | 199 61 842 | 7/2001 |
| DE | 101 45 100 | 5/2002 |
| DE | 103 03 263 | 8/2004 |
| DE | 202005001559 | 6/2005 |
| DE | 10 2005 008 512 | 8/2006 |
| EP | 0077615 | 4/1983 |
| EP | 0774888 | 5/1997 |
| EP | 0 742 643 | 2/2002 |
| FR | 2 799 883 | 4/2001 |
| JP | 55-134942 | 10/1980 |
| JP | 55-150575 | 10/1980 |
| JP | 57-100754 | 6/1982 |
| JP | 57-207500 | 12/1982 |
| JP | 61-033509 | 12/1982 |
| JP | 58-030394 | 2/1983 |
| JP | 58-203016 | 11/1983 |
| JP | 62-230297 | 10/1987 |
| JP | 03-116899 | 5/1991 |
| JP | 04-281696 | 10/1992 |
| JP | 06-81133 | 11/1994 |
| JP | 06-334298 | 12/1994 |
| JP | 07-212180 | 8/1995 |
| JP | 07-212181 | 8/1995 |
| JP | 07-297667 | 11/1995 |
| JP | 08-043435 | 2/1996 |
| JP | 05-299963 | 11/1996 |
| JP | 09-153762 | 6/1997 |
| JP | 10-321666 | 12/1998 |
| JP | 11-026628 | 1/1999 |
| JP | 11-508101 | 7/1999 |
| JP | 11-274892 | 10/1999 |
| JP | 2001-157298 | 6/2001 |
| JP | 2001-339796 | 12/2001 |
| JP | 2002-134875 | 5/2002 |
| JP | 2003-078981 | 3/2003 |
| JP | 2003-508998 | 3/2003 |
| JP | 2003-304595 | 10/2003 |
| JP | 2004-079776 | 3/2004 |
| JP | 2004-088566 | 3/2004 |
| JP | 2004-153408 | 5/2004 |
| JP | 2004-229200 | 8/2004 |
| JP | 2004-537182 | 12/2004 |
| JP | 2005-198051 | 7/2005 |
| JP | 2005-241380 | 9/2005 |
| JP | 2005-244642 | 9/2005 |
| JP | 2005-249666 | 9/2005 |
| JP | 2005-294462 | 10/2005 |
| JP | 2007-060661 | 3/2007 |
| JP | 2007-524514 | 8/2007 |
| JP | 2008-532369 | 8/2008 |
| JP | 2009-501442 | 1/2009 |
| WO | WO97/01258 | 1/1997 |
| WO | WO99/43084 | 8/1999 |
| WO | WO99/56390 | 11/1999 |
| WO | WO00/42636 | 7/2000 |
| WO | WO00/70630 | 11/2000 |
| WO | WO01/19134 | 3/2001 |
| WO | WO01/20948 | 3/2001 |
| WO | WO01/26136 | 4/2001 |
| WO | WO01/41497 | 6/2001 |
| WO | WO02/15636 | 2/2002 |
| WO | WO02/45463 | 6/2002 |
| WO | WO03/017364 | 2/2003 |
| WO | WO2004/019490 | 3/2004 |
| WO | WO2004/051745 | 6/2004 |
| WO | WO2005/036698 | 4/2005 |
| WO | WO2005/086532 | 9/2005 |
| WO | WO2005/086534 | 9/2005 |
| WO | WO2005/086535 | 9/2005 |
| WO | WO2005/102910 | 11/2005 |
| WO | WO2006/089638 | 8/2006 |
| WO | WO2006/089641 | 8/2006 |
| WO | WO2007/010361 | 1/2007 |
| WO | WO2007/022249 | 2/2007 |

OTHER PUBLICATIONS

Notification of Reasons for Refusal (english translation) in Japanese Patent Application No. 2008-539238, dated Nov. 11, 2011.

International Search Report for PCT/EP06/001121.

Written Opinion for PCT/EP06/001121.

Arnold D. P. et al "A Directional Acoustic Array Using Silicon Micromachined Piezoresistive Microphones" J. of Acoustic Soc. Am. vol. 113, Jan. 2003, pp. 289-298.

Bay J. et al "Design of a Silicon Microphone with Differential Readout of a Sealed Double Parallel-Plate Capacitor" Int. Conf. Eurosensors, Jun. 25, 1995, pp. 700-703, XP010305041.

Van der Donk et al "Amplitude-modulated Electromechanical Feedback System for Silicon Condenser Microphones" J. Micromech. Microeng. 2 (1992) 211-214, XP020069302.

Becker Karl-F et al "MEMS Packaging—Technological Solutions for a Si-Microphone" Fraunhofer Inst. for Reliability and Micro

(56) References Cited

OTHER PUBLICATIONS

Integration, Berlin; p. 405-406; Mar. 2004; ISBN: 2952110514; 2952110522.
Hsieh, W. H. et al "A Micromachined Thin-film Teflon Electret Microphone" Dept. of Electrical Engineering, California Inst. of Technology ; vol. 1 p. 2B2.02 IEEE, 1997.
Lukes M. "Silicon Condenser Microphone: Electroacoustic Model and Simulation" Czech Tech. University in Prague, Faculty of Electrical Engineering, Sep. 26, 2001, pp. 57-66.
Neumann J. J. et al "A Fully-integrated CMOS-MEMS Audio Microphone" 12th Intl Conf. on Solid State Sensors, Actuators and Microsystems, Boston, Jun. 8-12, 2003, pp. 230-233.
Niu M-N. et al "Piezoeclectric Bimorph Microphone Built on Micromachined Parylene Diaphragm" J. of Microelectrochemical Systems, vol. 12, No. 6, Dec. 2003; pp. 892-898, XP001200226, ISSN 1057-7157.
Nobuomi Imai "A New Piezoelectric Microphone with Divided Electrodes and its Applications" J. Acoust. Soc. Jpn. (E) 11,6 (1990) pp. 327-333.
Zhao Y. et al "MEMS-Based Piezoelectric Microphone for Biomedical Applications" MEMES Sensors and Actuators Lab (MSAL), Dept. of Electrical and Computer Engineering, The Inst. for Systems Research, U. of Maryland.
Notification of Reasons for Refusal (English translation) in Japanese Patent Application No. 2008-535876, dated Dec. 8, 2011.
Notification of Reasons for Refusal (English translation) in Japanese Patent Application No. 2007-556516, dated Apr. 12, 2012.
Action and Response History in U.S. Appl. No. 11/816,964.
Action and Response History in U.S. Appl. No. 12/092,423.
Action and Response History in U.S. Appl. No. 12/092,439.
Office Action in U.S. Appl. No. 11/816,960, dated Mar. 12, 2013.
Notification of Reasons for Refusal (English translation) in Japanese Patent Application No. 2008-535876, dated Jul. 11, 2012.
Action and Response History in U.S. Appl. No. 11/816,960.
Action and Response History in U.S. Appl. No. 12/090,529.
Action and Response History in U.S. Appl. No. 13/075,936.
Notice of Allowance in U.S. Appl. No. 13/075,936, dated Dec. 26, 2012.
International Preliminary Report on Patentability in Application No. PCT/EP05/004309, dated Nov. 29, 2006.
International Search Report and Written Opinion in Application No. PCT/EP05/004309, dated Sep. 13, 2005.
International Preliminary Report on Patentability in Application No. PCT/DE2006/001736, dated Apr. 29, 2008.
International Search Report and Written Opinion in Application No. PCT/DE2006/001736, dated Mar. 12, 2007.
International Search Report and Written Opinion in Application No. PCT/DE2006/001946, dated Feb. 22, 2007.
International Preliminary Report on Patentability in Application No. PCT/DE2006/001946, dated Jun. 11, 2008.
International Search Report and Written Opinion in Application No. PCT/DE2006/001945, dated Mar. 28, 2007.
International Preliminary Report on Patentability in Application No. PCT/DE2006/001945, dated Jun. 11, 2008.
International Search Report and Written Opinion in Application No. PCT/EP03/06596, dated Jan. 20, 2004.
International Search Report in Application No. PCT/EP2006/001116, dated Aug. 31, 2006.
International Preliminary Report on Patentability in Application No. PCT/EP2006/001116, dated Sep. 11, 2007 (incl. Written Opinion).
International Search Report and Written Opinion in Application No. PCT/EP2005/008373, dated Nov. 8, 2005.
International Preliminary Report on Patentability and Written Opinion for PCT/EP2006/001120, dated Sep. 11, 2007.
International Search Report in Application No. PCT/EP2006/001120, dated Oct. 26, 2006.
International Search Report in Application No. PCT/EP2006/001121, dated Jul. 7, 2006.
International Preliminary Report on Patentability and Written Opinion for PCT/EP2006/001121, dated Sep. 11, 2007.
Machine Translation of German Publication No. DE10303263A1, published Aug. 2004.
Notification of reasons for Refusal in Japanese Patent Application No. 2007-556514, dated Jul. 13, 2011.
Notification of reasons for Refusal in Japanese Patent Application No. 2007-556515, dated Jun. 23, 2011.
Notification of reasons for Refusal in Japanese Patent Application No. 2007-556516, dated Sep. 22, 2011.
Notification of reasons for Refusal in Japanese Patent Application No. 2008-539239, dated Sep. 22, 2011.
Action and Response History in U.S. Appl. No. 10/523,875.
Action and Response History in U.S. Appl. No. 11/578,854.
Action and Response History in U.S. Appl. No. 11/573,610.
Prosecution History in Re-Exam 95/000,509 (RE of US6,781,231).
Prosecution History in Re-Exam 95/000,513 (RE of US7,242,089).
Prosecution History in Re-Exam 95/000,515 (RE of US7,242,089).
Prosecution History in Re-Exam 90/009,739 (RE of US7,242,089).
Prosecution History in Re-Exam 90/009,740 (RE of US6,781,231).
Arnold et al., "MEMS-Based Acoustic Array Technology", 40th AIAA Aerospace Sciences Meeting and Exhibit, (Jan. 2002).
Arnold, David P., "A MEMS-Based Directional Acoustic Array for Aeroacoustic Measurements", Master's Thesis, Univ. of Florida (2001).
Barton et al., "Optimisation of the Coating of a Fiber Optical Sensor Embedded in a Corss-ply GFRP Laminate" Composites: Part A 33 (2002) pp. 27-34.
Bergqvist et al., "A Silicon Condenser Microphone Using Bond and Etch-Back Technology", Sensors and Actuators A, vol. 45, pp. 115-124 (1994).
Bever et al., "BICMOS Compatible Silicon Microphone Packaged as Surface Mount Device", Sensors Expo (1999).
Bouchard et al., "Dynamic Times for MEMS Microphones: MEMS Microphone Market & Supplier Analysis 2006-2013", iSuppli Corporation (2009).
Electronic Materials handbook, p. 483 (Fig. 1), ASM Int'l., (1989).
Foresight Institute, "Nano 50 Awards Announced", [online] Retrieved from the Internet:<URL: http://www.foresight.org/nanodot/?p=1990>, (Jul. 2005).
Gale, Bruce K., "MEMS Packaging", Microsystems Priciples (Oct. 2001).
Giasolli, Robert, "MEMS Packaging Introduction", (Nov. 2000).
Gilleo, "MEMS/MOEMS Packaging: Concepts, Designs, Materials & Processes", MEMS and MOEMS Packaging Challenges and Strategies, McGraw-Hill Companies, Inc., ch. 3:84-102, (2005).
Gilleo, Ken, ed., Excerpt from Area Array Packaging Handbook, (2002).
Gilleo, K. Handbook of flexible circuits, Gilleo, K. (ed), Van Nostrand Reinhold, 1992, pp. 145-166 [Ch. 8—Integrated Features].
Hannenmann et al., eds., Semiconductor Packaging: A Multidisciplinary Approach (1994).
Harper, Chas. et al., Electronic Packaging, Microelectronics and Interconnection Dictionary, pp. 139, 190-191 (1993).
Harper, Chas., ed., Electronic Packaging and Interconnection Handbook, 3rd Ed., McGraw-Hill, pp. 7.34 to 7.38 (2000).
Hayes et al., "Micro-jet printing of polymers for electronics manufacturing" IEEE; pp. 168-173, XP 002342861 (1998).
Hayes et al., "Printing systems for MEMS packaging" vol. 4558, 2001, pp. 206-214, XP 002342860.
Henning et al., "Microfluidic MEMS for Semiconductor Processing", IEEE Trans. On Components, Packaging and Manufacturing Technology, Pt. B, vol. 21(4), pp. 329-337 (Nov. 1998).
Hsu, "MEMS Packaging: Fundamentals of MEMS Packaging", INSPEC, Inst. of Electrical Engineers, pp. 17-19 (2004).
Jedec Standard, "Terms, Definitions and Letter Symbols for Microelectronic Devices", JEDEC Solid State Technology Assoc., Electronic Industries Alliance, JESD99A (Rev. of Feb. 2000, Mar. 2007).
Kress et al., "Integrated Silicon Pressure Sensor for Automotice Applications with Electronic Trimming", SAE Document 950533 (1995).
Lau, John H., Ed., Ball Grid Array Technology, McGraw Hill, Inc., ISBN 0-07-036608-X, (Pub. 1995).

(56) References Cited

OTHER PUBLICATIONS

Luthra, Mukluk, Process challenges and solutions for embedding Chip-On-Board into mainstream SMT assembly, pp. 426-433, Proc. Of the 4th Int'l. Symposium on Electronic Materials and Packaging (Dec. 2002).
Maluf, Nadim, "An Introduction to Microelectromechanical Systems Engineering; , The Box: Packaging for MEMS", ch. 6:201-203 (2000).
National Semiconductor Corp., "Acoustic Applications of Pressure Transducers", *Pressure Transducer Handbook*, pp. 12-1 to 12-5, (1977).
National Semiconductor Corp., "Configurations, Packaging and Environment", *Pressure Transducer Handbook*, pp. 4-2 to 4-5, (1977).
Oda et al., "New Nanostructured Film Making Method Using Ultra Fine Particles"; pp. 21-26 (Feb. 1997).
O'Neal, Chad et al., Challenges in the Packaging of MEMS, IEEE Int'l Symposium on Advanced Packaging Materials (1999).
Pecht, Michael, ed., Handbook of Electronic Package Design, pp. 1-5, Fig. 1.1 (1991).
Petersen et al., "Silicon Accelerometer Family; Manufactured for Automotive Applications", (1992).
Premachandran, C. S. et al., "Si-based Microphone Testing Methodology and Noise Reduction", Proc. Of SPIE, vol. 4018, p. 588 (2000).
Ramesham, Rajeshuni et al., Challenges in Interconnection and Packaging of Microelectromechanical Systems (MEMS), Electronic Components and Technology Conference (2000).
Schweber & Clark, "And the statuette goes to . . . ", [online] Retrieved from the Internet:<URL: www.tmworld.com/file/13638-509581.pdf?force=true>, Electronics Design, Strategy, News (EDN), (Mar. 2005).
Selmeier et al., "Recent Advances in Saw Packaging", IEEE Ultrasonics Symposium; 2001; pp. 283-292.
"Small Times Magazine Best of Small Tech Awards Recognize Micro and Nano Technologies Affecting Today's World", [online] Retrieved from the Internet: <URL: http://www.nanotechwire.com/news.asp?nid=539>, [Nov. 10, 2003].
Torkkeli et al., "Capacitive Microphone with low-stress polysilicon membrane and high-stress polysilicon back plate", Sensors and Actuators 85, pp. 116-123 (Aug. 25, 2000).
Torkkeli et al., "Capacitive Silicon Microphone", Physica Scripta, vol. T79, pp. 275-278, 1999, (Published at least by May 14, 1992).
Tummala, Rao, ed., Fundamentals of Microsystems Packaging, McGraw-Hill Companies, Inc., Ch. 14:560-561 (2001).
van Heeren, et al., "Overview of MEMS Process Technologies for high Volume Electronics", 17 pgs. (Pub. Date: 2005 or later).
Wikipedia, "Flip Chip", [online] Retrieved from the Internet: <URL: http://en.wikipedia.org/wiki/Flip_chip>, [retrieved on Nov. 15, 2011].

* cited by examiner

MEMS MICROPHONE

TECHNICAL FIELD

This patent application describes a MEMS microphone (MEMS=Micro Electromechanical System).

BACKGROUND

U.S. Pat. No. 4,816,125 describes a MEMS microphone with a piezoelectric layer made from ZnO and several electrodes connected to this layer that are arranged concentrically.

The following publication describes a microphone module with an encapsulated MEMS microphone, in which an enclosed air volume (back volume) is in a housing underneath the microphone's diaphragm: J. J. Neumann, Jr. and K. J. Gabriel, "A fully integrated CMOS-MEMS audio microphone," the 12th International Conference on Solid State Sensors, Actuators, and Microsystems, 2003 IEEE, pp. 230-233.

The following publication describes an electrical module with an installed MEMS piezoresistive microphone: D. P. Arnold, et al., "A directional acoustic array using silicon micromachined piezoresistive microphones," J. Acoust. Soc. Am., Vol. 113(1), 2003, pp. 289-298.

The following publication describes a piezoelectric microphone, which has two piezoelectric layers made from ZnO and a floating electrode arranged in-between: Mang-Nian Niu and Eun Sok Kim, "Piezoelectric Bimorph Microphone Built on Micromachined Parylene Diaphragm," Journal of Microelectromechanical Systems, Vol. 12, 2003 IEEE, pp. 892-898.

SUMMARY

Described herein is a sensitive microphone with a high signal-to-noise ratio.

It has been found that microphones that detect sound pressure using diaphragms are usually dependent on a large diaphragm displacement as a reaction to sound intensity in order to achieve desired characteristics in terms of sensitivity and noise behavior. For small components with built-in microphones, achievable displacement is limited by small diaphragm area. When diaphragm displacement is converted into an electrical quantity, only weak electrical signals can be obtained. The elasticity of a diaphragm produced in a deposition process can be negatively affected by a bias caused by a high internal mechanical stress.

MEMS microphones described here have an air chamber connected to a sound inlet opening and also a back volume. An enclosed air volume that prevents an acoustic short circuit—an undesired pressure balance between the front and back sides of the oscillating diaphragm—is referred to as a back volume. This air volume generates a restoring force for each diaphragm displacement in addition to the restoring force caused by the elastic diaphragm characteristics. For small components, the back volume is so small that even small diaphragm displacements lead to a considerable increase in pressure in the back volume, which can be on the order of magnitude of the sound level to be detected. The additional restoring force decreases the elasticity and the displacement of the diaphragm.

A microphone is described with a first and a second diaphragm, which are each connected to one and the same closed air volume and are thus coupled to each other so that, for a displacement of the first diaphragm, a simultaneous displacement of the second diaphragm is generated.

The first diaphragm is a microphone diaphragm, i.e., a "passive" diaphragm, which detects the sound pressure or converts an acoustic signal into an electrical signal. The second diaphragm is an auxiliary diaphragm or an "active" diaphragm, whose displacement generated by electrical driving interacts with the "passive" diaphragm via the closed air volume.

Two different strategies are described for the electrically driving the active diaphragm:

1) "Holding the enclosed air volume constant": For this purpose, a signal derived from the passive diaphragm and amplified is fed to the active diaphragm such that the active diaphragm performs an opposite but equal-magnitude motion that is similar or identical to that of the passive diaphragm. For example, if the passive diaphragm is driven to a certain volume displacement towards the interior of the cavity by the external sound pressure, then an electrical driving of the active diaphragm by the approximately equivalent volume displacement away from the interior of the cavity is realized. As a result, the fluctuation of the chamber volume is reduced or eliminated. In this way, it is possible to reduce pressure fluctuations caused by the sound pressure in the closed air volume considerably, e.g., by at least a factor of two, in one embodiment by at least a factor of five. This reduction in internal pressure fluctuations, however, also means a corresponding reduction in the diaphragm restoring force. The effective back volume thus appears significantly enlarged, in the limiting case as infinite.

2) "Compensation of the passive diaphragm displacement": Here, the electrical driving of the active diaphragm is part of a control circuit that reduces or even eliminates the displacement of the passive diaphragm, despite the effect of the external acoustic field on the passive diaphragm. A measure for this displacement is the electrical output signal of the passive diaphragm, which is held close to zero by the control circuit. At each moment, the active diaphragm establishes, for this purpose, an internal pressure in the chamber, which is close or equal to the external pressure (sound pressure). The resulting differential pressure for the passive diaphragm is reduced or disappears completely, which also applies to its displacement. Without significant diaphragm displacement of the passive diaphragm, however, the back volume causes, in turn, no relevant restoring forces on this diaphragm. The output signal of the arrangement in this case is not that of the passive diaphragm (which is definitely driven to zero in the described way), but instead the drive signal of the active diaphragm formed in the control circuit.

In both cases, a virtual back volume is achieved that is greater than the real back volume by a multiple (in one construction by at least two times, in one embodiment construction by at least five times).

The two circuit-related strategies for reducing the effective restoring force run the risk of building up feedback oscillations in the entire system. In one embodiment, therefore, circuit-related measures are provided for recognizing and preventing such conditions.

In a first construction, a microphone is specified with a body in which two openings are provided, which open into a cavity formed in the body. A first diaphragm is arranged over a first opening and a second diaphragm (auxiliary diaphragm) is arranged over a second opening, so that an air volume is enclosed in the cavity. The second diaphragm may be decoupled acoustically from the exterior by another cavity. A space in which the source of an acoustic input signal is located is referred to as the exterior.

A chamber that is connected to the exterior and isolated from the cavity is arranged over the first diaphragm. The cavity is designated below as the back volume.

The first diaphragm is arranged in a first cavity wall over an opening formed in this wall. In one embodiment, the second diaphragm is arranged in a second cavity wall. The diaphragms may be arranged in opposite cavity walls. Because the acoustic pressure change is transmitted equally in all directions when the diaphragm is dispersed, it is also possible to arrange the two diaphragms in walls standing at right angles to each other. The two diaphragms can be arranged in the same cavity wall.

The two diaphragms may have essentially the same mass and can be formed identically. The (passive) first diaphragm acts as a microphone diaphragm, while the (driven) second diaphragm functions as a loudspeaker diaphragm. In the case of a piezoelectric MEMS microphone based on the direct piezoelectric effect, for example, the displacement of the first diaphragm is converted into an electrical signal. In a capacitive MEMS microphone, the relative position of the electrodes of the microphone changes. The associated change in capacitance is converted into an electrical signal. The respective diaphragm can be basically an electromechanical converter operating with an electric field or magnetic field.

The displacement of the second diaphragm can be generated like in a loudspeaker, e.g., by a changing electric or magnetic field. The displacement of the second diaphragm with piezoelectric properties can be generated on the basis of the inverse piezoelectric effect.

In an embodiment, both diaphragms each have at least one piezoelectric layer. Both diaphragms may be constructed identically. Alternatively, it is possible for the electromechanical conversion in the diaphragms to be based on different electromechanical effects. For example, the first diaphragm can function as a capacitive MEMS microphone and the second diaphragm can function as a piezoelectric converter.

In one embodiment, a vent opening can be provided, which connects the enclosed air volumes (back volume of the microphone) and the exterior and which is small relative to the cross-sectional size of the diaphragm and which is used for slow pressure balancing, e.g., in the range of ≥100 ms. The pressure balancing is performed slowly relative to the period of an acoustic signal with the largest wavelength in the operating range of the microphone. This opening can be arranged in the diaphragm or in a wall of the container that encloses the acoustic back volume.

By virtue of the described compensation measures according to the first and the second embodiment, it is possible to reduce the real acoustic back volume (i.e., the closed air volume) relative to known microphones without an auxiliary diaphragm, so that space savings can be achieved. Nevertheless, because the virtual back volume can be kept sufficiently large, no disadvantageous consequences (loss of sensitivity) occur due to the smaller construction.

To prevent an acoustic short circuit of a driven auxiliary diaphragm to the exterior or to the sound inlet opening, an additional cavity isolated from the exterior is provided in an advantageous variant as an acoustic back volume for the auxiliary diaphragm. The additional cavity is separated by the auxiliary diaphragm from the closed air volume. The additional cavity can be smaller than the closed air volume, because the auxiliary diaphragm is driven actively and thus its displacement is set. The space requirements of the microphone arrangement can accordingly be kept small overall.

A microphone will be explained in detail below on the basis of embodiments and the associated figures. The figures show different embodiments of the microphone on the basis of schematic representations that are not to scale. Parts that are identical or that have identical functions are labeled with the same reference symbols.

DETAILED DESCRIPTION

Figure 1A:
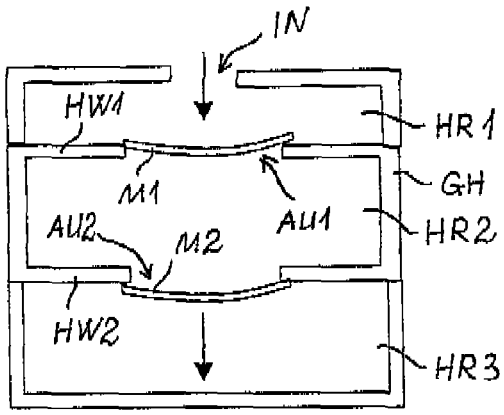
FIG. 1A, a part of a microphone according to a first embodiment, comprising two electrically coupled diaphragms in a schematic cross section.

FIG. 1A shows a microphone with a body GH, which has openings AU1, AU2 opening into a cavity HR2 on its opposing walls HW1, HW2. A first diaphragm M1 (microphone diaphragm, passive diaphragm) is arranged over the first opening AU1 and a second diaphragm M2 (auxiliary diaphragm, driven diaphragm) is arranged over the second opening AU2.

The diaphragm M1, M2 can be mounted on the walls of the body GH. Alternatively, the diaphragm M1, M2 can be replaced by a microphone chip with a carrier substrate and a diaphragm mounted thereon. The microphone chip can be connected fixedly to the body GH, e.g., by an adhesive layer.

The first diaphragm M1 separates the cavity HR2 from a chamber HR1, which is connected to the exterior via a sound inlet opening IN. The first diaphragm M1 begins to vibrate as soon as an acoustic pressure p is exerted on it. The change in pressure in the chamber HR1 and the vibration of the diaphragm M1 would lead to a change in volume or pressure in the cavity HR2 (without the auxiliary diaphragm M2) and an associated restoring force, which acts on the first diaphragm M1 and reduces the vibration amplitude. Due to an electrical coupling of the two diaphragms M1, M2, they vibrate in such a manner that the displacement of the first diaphragm M1 is towards the interior of the cavity HR2 and the displacement of the second diaphragm M2 is realized with the same amplitude towards the outside. The active diaphragm M2 is driven in a push-pull way with respect to the passive first diaphragm M1. Here, a reduced change or no change at all in the volume of the cavity HR2 occurs.

The second diaphragm M2 separates the cavity HR2 from an additional closed cavity HR3, which is isolated from a space connected to a sound source, i.e., the exterior and the chamber HR1. The additional cavity HR3 prevents feedback of the active diaphragm onto the passive diaphragm on the outer path.

The additional cavity HR3 and/or the chamber HR1 can be created, e.g., by a cap-shaped, dimensionally stable cover.

Figure 1B:
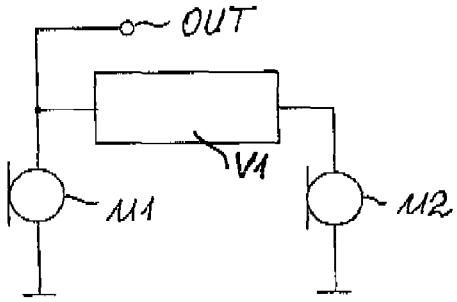
FIG. 1B, equivalent circuit diagram of the microphone according to FIG. 1A.

In FIG. 1B, a simplified equivalent circuit diagram of diaphragms M1, M2 coupled by a control circuit V1 is shown. For a displacement of the passive diaphragm M1 caused by the sound pressure, an electrical signal is generated that can be tapped at the output OUT as a usable signal for further processing. A part of the electrical signal is used for generating a control signal at the output of the control circuit V1, with which the auxiliary diaphragm M2 is driven in a push-pull way (relative to the internal pressure established in the cavity HR2) with respect to the passive diaphragm.

The drive circuit V1 may contain an amplifier for amplifying the signal tapped at the diaphragm M1.

Figure 2:
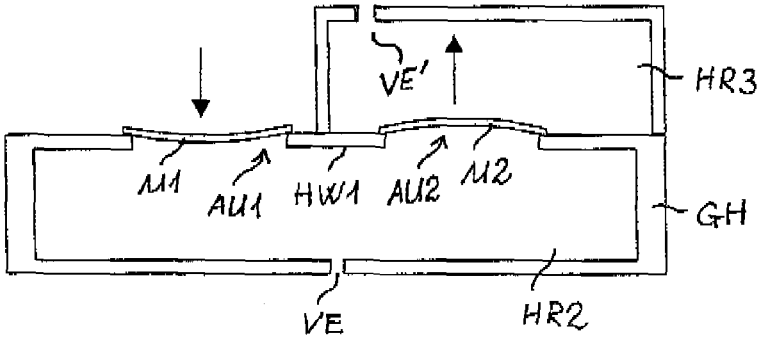
FIGS. 2, 3, each a variant of the embodiment shown in FIG. 1.

FIG. 2 shows an embodiment of the microphone presented in FIG. 1, in which both diaphragms M1, M2 are arranged in the same cavity wall HW1. In a cavity wall of the cavity HR2, a small ventilation opening VE connecting this cavity and the exterior is provided, whose cross-sectional size is clearly smaller (e.g., by at least a factor of 100) than the cross-sectional size of the diaphragm or the openings AU1 or AU2 and which is used for slow pressure balancing, e.g., in the range of ≥100 ms. In a cavity wall of the cavity HR3, a small ventilation opening VE' connecting this cavity and the exterior is also provided.

Figure 3:
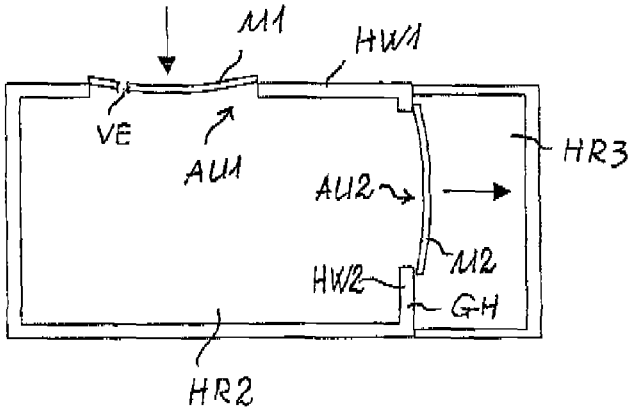

In FIG. 3, the openings AU1, AU2 are provided in mutually perpendicular walls. The ventilation opening VE is formed here in the diaphragm M1.

The direction of the diaphragm displacement is indicated with arrows in FIGS. 1 to 4A, B.

Figure 4A:
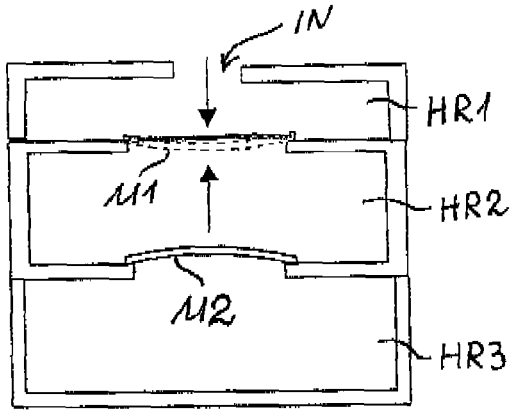
FIG. 4A, a part of a microphone according to the second variant.

In a variant of the embodiment presented in FIG. 4A, the active second diaphragm M2 is driven in a push-pull way (relative to the internal pressure) with the passive first diaphragm M1 in contrast to FIG. 1A. Here, the displacements of the two diaphragms are directed towards the interior of the air volume enclosed in the cavity HR2. In FIG. 4A, a dashed line shows how the passive diaphragm M1 would deform due to external sound pressure. A solid line shows the actual position of the diaphragm M1 achieved due to the compensating effect of the active diaphragm M2, wherein the diaphragm M1 remains practically in its rest position or oscillates with a very small amplitude relative to the displacement of the active diaphragm M2.

Figure 4B:
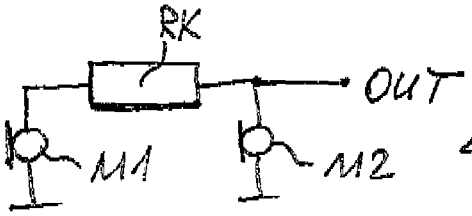
FIG. 4B, equivalent circuit diagram of the microphone according to FIG. 4A.

FIG. 4B shows an equivalent circuit diagram to the embodiment according to FIG. 4A. The electrical signal tapped at the diaphragm M1 is processed by the control circuit RK. On one hand, a control signal for driving the diaphragm M2 is output and, on the other, another control signal, which is superimposed on the signal tapped at the diaphragm M1 and damps the oscillation amplitude of the diaphragm M1. An output signal at the output OUT can be evaluated. The output OUT is connected here to the diaphragm M2.

In the variants presented in FIGS. 2 and 3, it is also possible to drive the active diaphragm M2 in common mode relative to the passive diaphragm M1, in order to damp the displacement amplitude of the passive diaphragm M1 in addition to the restoring force acting on this diaphragm.

Figure 5:
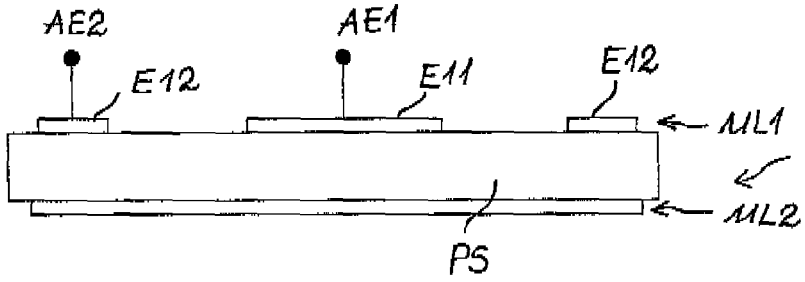
FIG. 5, an example microphone diaphragm in a schematic cross section.
Figure 6:
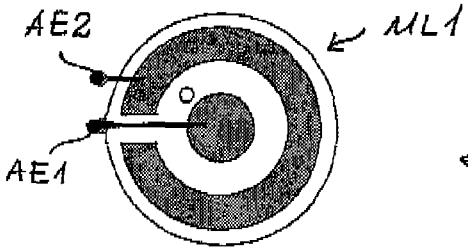
FIG. 6, a metal layer, in which two electrodes connected electrically to external contacts are formed.

FIG. 4B shows the equivalent circuit diagram of a microphone, which comprises a control circuit RK for compensating the displacement of the diaphragm M1. The output signal OUT2 is obtained here from the control circuit, while the signal of the converter M1 is held close to zero by the effect of the control. An example of a diaphragm with a piezoelectric layer PS arranged between two metal layers ML1, ML2 is shown in FIGS. 5 and 6. Electrodes E11 and E12 connected to the external contacts AE1, AE2 are arranged in the first metal layer ML1. A floating conductive area, which lies opposite the two electrodes E11, E12, is formed in the second metal layer ML2. Here, two capacitors connected to each other in series are formed.

In FIG. 6, a first metal layer ML1 of the diaphragm presented in FIG. 5 is shown. The round electrode E11 is arranged in a first high-potential region and the annular electrode E12 is arranged in a second high-potential region. The two high-potential regions have opposite polarity. The electrodes E11, E12 are each connected to external contacts AE1 and AE2, respectively. In a metal layer ML2 arranged underneath or above and shown in FIG. 5, a continuous, floating, conductive surface may be arranged, which is opposite the two electrodes E11, E12.

The microphone is not limited to the number of elements shown in the figures or to the acoustically audible range from 20 Hz to 20 kHz. The microphone can also be used in other piezoelectric acoustic sensors, e.g., distance sensors operating with ultrasound. A microphone chip with a described microphone can be used in any signal-processing module. Different embodiments can also be combined with each other.

The invention claimed is:

1. A microphone comprising:
- a first diaphragm that is passive and thus not responsive to an electrical signal;
- a driver to generate a signal in response to displacement of the first diaphragm; and
- a second diaphragm coupled to the first diaphragm by a closed air volume, the second diaphragm being active and being movable in response to the signal generated by the driver;
- wherein the first diaphragm and the second diaphragm each comprises a piezoelectric diaphragm.

2. The microphone of claim 1, further comprising
- structure that defines a first cavity, the structure having a first opening and a second opening that lead to the first cavity;
- wherein the first diaphragm is over the first opening and the second diaphragm is over the second opening, thereby defining the closed air volume;
- wherein the second diaphragm is controlled by the signal so that, if the first diaphragm moves towards an interior of the first cavity, the second diaphragm moves away from the interior of the first cavity; and
- wherein a volume displacement resulting from movement of the second diaphragm is between 50% and 100% of a volume displacement resulting from movement of the first diaphragm.

3. The microphone of claim 1, wherein movement of the first diaphragm and movement of the second diaphragm occur in a same direction relative to the closed air volume.

4. The microphone of claim 3, further comprising
- structure that defines a first cavity, the structure having a first opening and a second opening that lead to the first cavity;
- wherein the first diaphragm is over the first opening and the second diaphragm is over the second opening, thereby defining the closed air volume; and
- wherein a volume displacement resulting from movement of the second diaphragm is between 50% and 100% of a volume displacement resulting from movement of the first diaphragm.

5. The microphone of claim 1, wherein the first diaphragm and the second diaphragm are not opposite each other relative to the closed air volume.

6. The microphone of claim 5, further comprising
- structure that defines a first cavity, the structure having a first opening and a second opening that lead to the first cavity;
- wherein the first diaphragm is over the first opening and the second diaphragm is over the second opening, thereby defining the closed air volume;
- wherein the second diaphragm is controlled by the signal so that, if the first diaphragm moves towards an interior of the first cavity, the second diaphragm moves away from the interior of the first cavity; and wherein a volume displacement resulting from movement of the second diaphragm is between 50% and 100% of a volume displacement resulting from movement of the first diaphragm.

7. The microphone of claim 1, wherein the closed air volume functions as a back volume; and wherein structure that defines the closed air volume includes a ventilation opening to balance an internal pressure of the closed air volume with an external pressure outside of the microphone, where pressure balancing occurs over a time that exceeds a period of an acoustic signal applied to the first diaphragm.

8. A microphone comprising:

a first diaphragm coupled to a closed air volume, the first diaphragm being passive and thus movable in response to pressure but not responsive to an electrical signal;

a second diaphragm being active and thus movable in response to a control signal, the second diaphragm being movable in response to the control signal to dampen an oscillation amplitude of the first diaphragm; and a driver to generate the control signal in response to movement of the first diaphragm.

9. The microphone of claim 8, wherein changes in pressure on both sides of the first diaphragm are essentially equal in magnitude.

10. The microphone of claim 8, wherein the control signal is for controlling the second diaphragm so that displacement of the first diaphragm results in displacement of the second diaphragm so as to produce a change in pressure in the closed air volume that substantially counteracts the pressure and thereby reduces displacement of the first diaphragm by 50%-100%.

11. The microphone of claim 8, wherein the second diaphragm is coupled to the closed air volume; and wherein the first diaphragm is connected to a first wall and the second diaphragm is connected to a second wall, the first and second walls being part of a structure that houses the closed air volume.

12. The microphone of claim 11, wherein the first and second walls face each other.

13. The microphone of claim 11, wherein the first and second walls are substantially perpendicular.

14. The microphone of 8, wherein the second diaphragm is coupled to the closed air volume; and wherein the first and second diaphragms are arranged along a same wall that is part of a structure that houses the closed air volume.

15. The microphone of claim 8, wherein the second diaphragm is coupled to the closed air volume; and wherein the first and second diaphragms have substantially same masses.

16. The microphone of claim 8, wherein the second diaphragm is coupled to the closed air volume; and wherein the first and second diaphragms have substantially same shapes.

17. The microphone of claim 8, further comprising:

a chamber that includes a sound inlet opening that leads to an exterior of the microphone, the chamber being adjacent to the first diaphragm and isolated from the closed air volume.

18. The microphone of claim 8, wherein the second diaphragm is coupled to the closed air volume; and wherein the driver comprises a control circuit to tap an electrical signal from the first diaphragm and to output the control signal to the second diaphragm to produce a displacement that affects internal pressure in the closed air volume and thereby reduces displacement of the first diaphragm.

19. The microphone of claim 18, wherein the control circuit comprises an amplifier.

20. The microphone of claim 8, wherein the second diaphragm is coupled to the closed air volume; and wherein a structure housing the closed air volume comprises at least one ventilation opening to an exterior of the microphone, the ventilation opening being is smaller than cross-sectional areas of the first and second diaphragms.

21. The microphone of claim 20, wherein the ventilation opening is in the first diaphragm or in a wall of the structure.

22. The microphone of one of claims 8, wherein the second diaphragm is coupled to the closed air volume; and wherein the closed air volume is a first closed air volume, and the second diaphragm is coupled to a second closed air volume on a side of the second diaphragm that is different from a side of the second diaphragm that faces the first closed air volume.

23. The microphone of claim 8, wherein the second diaphragm is coupled to the closed air volume; and wherein the driver comprises an electrical circuit connected to the first diaphragm and/or to the second diaphragm to reduce feedback oscillations.

* * * * *

UNITED STATES PATENT AND TRADEMARK OFFICE

CERTIFICATE OF CORRECTION

PATENT NO. : 8,582,788 B2
APPLICATION NO. : 11/816969
DATED : November 12, 2013
INVENTOR(S) : Anton Leidl It is certified that error appears in the above-identified patent and that said Letters Patent is hereby corrected as shown below:

On the Title Page, References Cited

Page 2, Col. 2 (U.S. Patent Documents), Line 26;
Delete "Bryson et al" and Insert -- Watson et al. --

Page 4, Col. 1 (Other Publications), Line 12;
Delete "Piezoeclectric" and Insert -- Piezoelectric --

Page 4, Col. 2 (Other Publications), Line 25;
Delete "Corss-ply" and Insert -- Cross-ply --

Page 4, Col. 2 (Other Publications), Line 39;
Delete "Priciples" and Insert -- Principles --

Page 4, Col. 2 (Other Publications), Line 67;
Delete "Automotice" and Insert -- Automotive --

In the Claims

Column 7, Claim 14, Line 46;
Delete "of 8," and Insert -- of claim 8, --

Column 8, Claim 20, Line 30;
Delete "being is" and Insert -- being --

Column 8, Claim 22, Line 35;
Delete "one of claims" and Insert -- claim --

Signed and Sealed this
Eleventh Day of March, 2014

Michelle K. Lee

Michelle K. Lee
*Deputy Director of the United States Patent and Trademark Office*